United States Patent [19]

Johnson, Jr.

[11] Patent Number: 4,934,244

[45] Date of Patent: Jun. 19, 1990

[54] ROTARY CHAMBER AUTOMATIC PISTOL

[76] Inventor: Craig C. Johnson, Jr., 4412 Dove Dr., Austin, Tex. 78744

[21] Appl. No.: 405,869

[22] Filed: Sep. 5, 1989

[51] Int. Cl.[5] ..... F41C 3/14

[52] U.S. Cl. ..... 89/12; 42/39.5

[58] Field of Search ..... 42/39.5; 89/12, 33.03, 89/155

[56] References Cited

U.S. PATENT DOCUMENTS

| | | | |
|---|---|---|---|
| 467,089 | 1/1892 | Forbes | 42/39.5 |
| 1,307,316 | 6/1919 | O'Malley | 89/33.03 |
| 2,317,579 | 4/1943 | Bacon | 42/6 |
| 2,970,521 | 2/1961 | Bell et al. | 89/33 |
| 3,706,259 | 3/1970 | Ashley et al. | 89/12 |
| 3,706,260 | 12/1972 | Rausing | 89/35 |
| 3,782,242 | 1/1974 | Angell et al. | 89/11 |
| 4,004,491 | 1/1977 | Seeling | 89/35 R |
| 4,159,670 | 7/1979 | Turner | 89/155 |
| 4,342,253 | 8/1982 | Kirkpatrick et al. | 89/12 |
| 4,653,356 | 3/1987 | Golden | 81/37.14 |

FOREIGN PATENT DOCUMENTS

| | | | |
|---|---|---|---|
| 20275 | of 1914 | United Kingdom | 89/155 |

*Primary Examiner*—Stephen C. Bentley

*Attorney, Agent, or Firm*—Joseph F. Long

[57] ABSTRACT

A battery powered rotary chamber pistol, suitable for firing 60 rounds per second of 22 caliber cartridges contained in a thin flexible belt without removing the cartridges from the belt.

1 Claim, 5 Drawing Sheets

ROTARY CHAMBER AUTOMATIC PISTOL

BACKGROUND

There are a variety of automatic weapons available but most are high caliber and thus, require bulky heavy cartridges to be available for any extended use. There appears to be a need for a lower caliber weapon that is potentially lethal at close range but would be less likely to injure a bystander than high caliber weapons. For commercial success there is also a need for a design suitable for low cost manufacture. The subject invention is suitable for use with 22 caliber long rifle cartridges, thus reducing the ammunition weight for in-use time when compared to high caliber weapons. Further, in the present invention the cartridges may be held in a belt that is as lightweight as masking tape. Ammunition may be fired without removal from the belt with the cartridge cases being held in the belt after firing. This is accomplished by having two pivotal members form a chamber and lock in place to perfectly align a cartridge with a barrel as a cartridge is fed between the two pivotal members and locked in place by a locker-ejector member before firing and that opens the two pivotal members and simultaneously raises the spent cartridge which is still in the belt for ejection from the unit after the cartridge is fired. Although multiple parts are used in the invention, most of the parts are ⅛" or less thick and may be stamped rather than machined, this should lead to lower manufacturing cost.

We have considered the following patents in this general field:

| Ser. No. | Date |
|---|---|
| 4,653,356 | 3/31/1987 |
| 4,004,491 | 1/25/1977 |
| 4,342,253 | 8/3/1982 |
| 3,782,242 | 1/1/1974 |
| 3,706,259 | 12/19/1972 |
| 3,706,260 | 12/19/1972 |
| 3,429,220 | 2/25/1969 |
| 3,380,345 | 4/30/1968 |
| 3,046,842 | 7/31/1962 |
| 2,970,521 | 2/7/1961 |
| 1,329,903 | 2/3/1920 |
| 1,307,316 | 6/17/1919 |
| 36,836 | 11/14/1862 |
| 2,317,579 | 4/27/1943 |

The subject invention appears to be uniquely different in several aspects among which are method of forming and locking cartridges in a holding chamber, a minimum distance horizontal travel for an automatic cocking mechanism, and use of a belt to hold the cartridges during firing and to hold spent cartridges thereafter.

SUMMARY OF THE INVENTION

The invention pertains to a rotary six barrel automatic weapon designed: (1) for 22 caliber cartridges; (2) to allow automatic feeding of cartridges in a belt as thin as masking tape; (3) to fire and eject cartridges without removing from the belt;; (4) to have a detachable magazine;, (5) to be battery driven; and (6) to weigh about six pounds..

DESCRIPTION OF THE INVENTION AND DRAWINGS

Figures 1, 2:
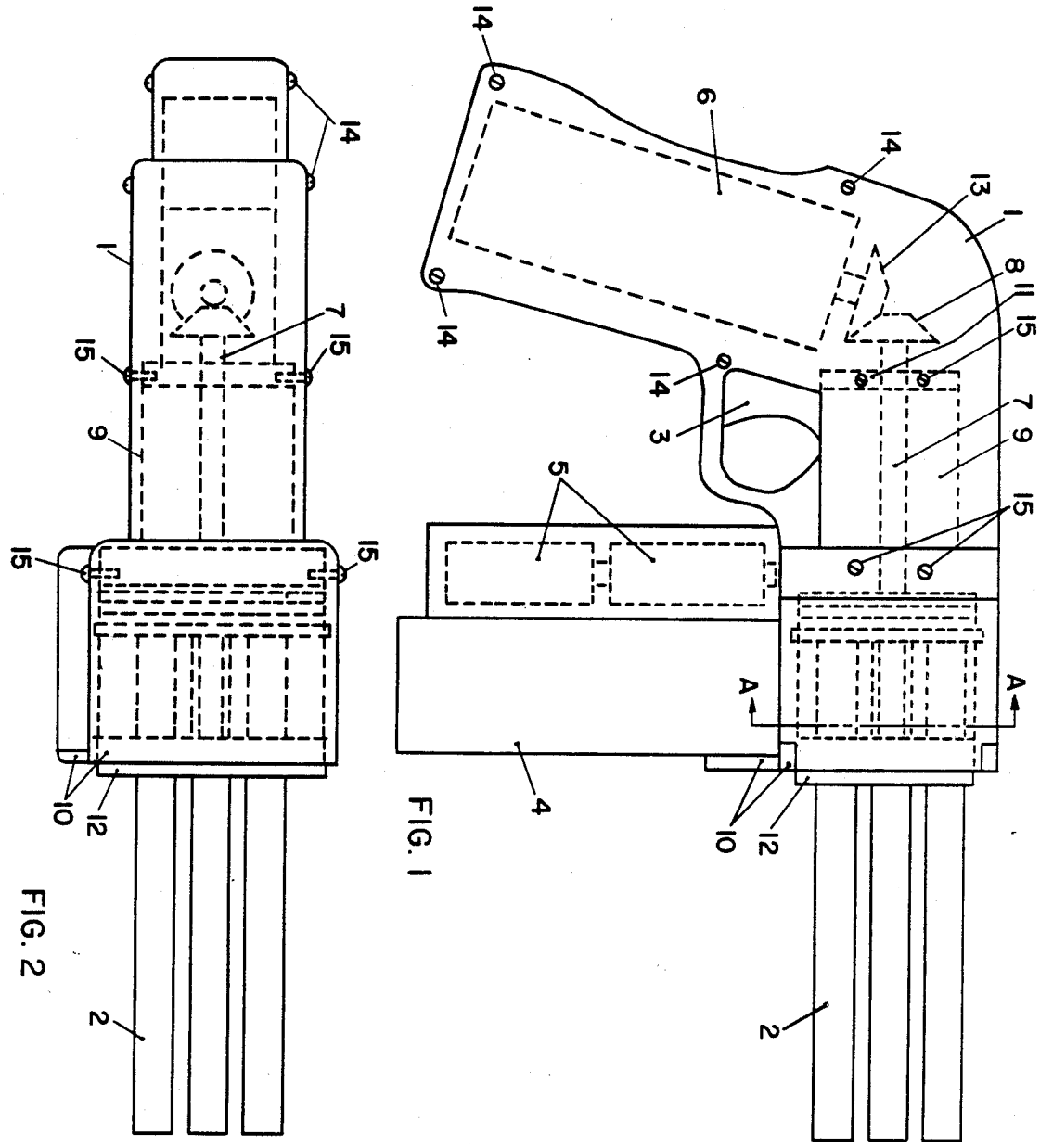
FIG. 1 shows a side view of the rotary chamber automatic pistol unit indicating internal motor drive, battery pack, and detachable magazine.
FIG. 2 shows a top view of the unit indicating a split external housing fastened to a stationary inner housing with screws and bolts.

FIG. 1 comprises:

1. a hardened steel main drive shaft 7, that may be approximately ½" in diameter and approximately 5" long with a pinion gear 8 on a rearward end driving another pinion gear 13 connected with a battery driven D.C. motor 6;

2. An external housing 1 that may be partially in a pistol grip shape to contain the battery driven motor 6 and a trigger type activator switch 3, with the external housing rigidly fastened to a stationary inner housing 9 with threaded screws 15 and with the portion containing the motor 6 fastened together with threaded bolts 14;

3. the stationary inner housing 9 which holds a rear bearing 11 for the main drive shaft 7 while a front bearing surface for the main drive shaft 7 is furnished by a bearing support and cartridge feed ramp 10 that slideably engages a barrel mounting base plate 12 that is approximately 2½" in diameter;

4. a detachable magazine 4 and battery pack holder 5; and 5. rotary barrels 2.

FIG. 2 shows a top view of the unit indicating a split external housing 1 fastened to the stationary inner housing 9 with screws 15 and fastened together in the handle area with slotted head bolts 14.

Figure 3:
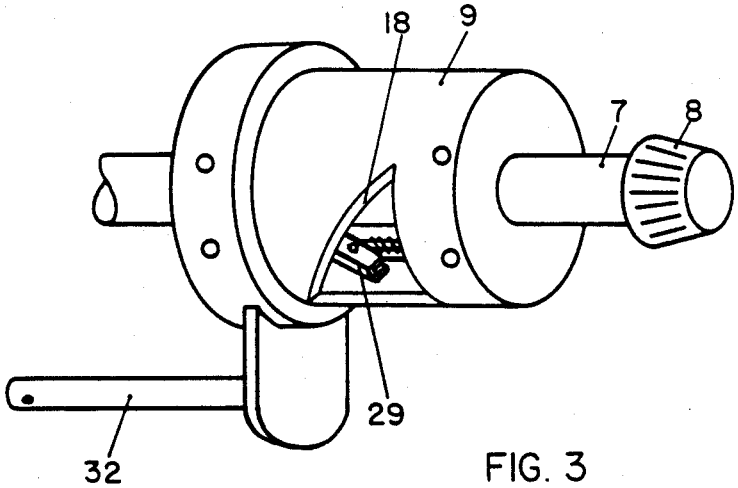
FIG. 3 shows one perspective view of the stationary inner housing showing the hammer cocking ramp.

In FIG. 3 we show one perspective view of stationary inner housing 9 indicating hammer cocking ramp 18 starting to push hammer 29 to a cocked position and a cartridge feed unit mounting pin 32. Function of this hammer cocking ramp 18 will be further discussed with details of operation of the hammers 29.

Figure 4:
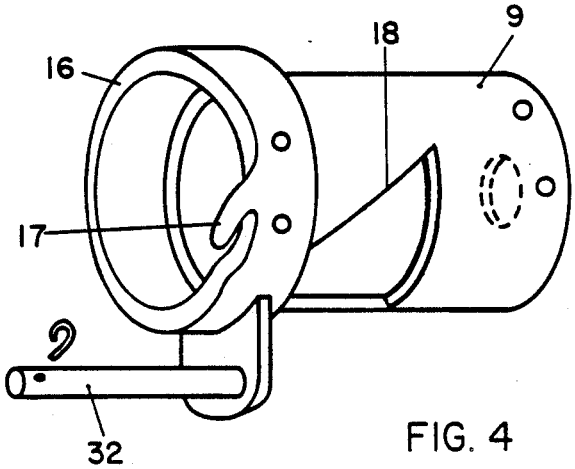
FIG. 4 shows a second perspective view of the stationary inner housing to show the locker-ejector drive ramp and ramp guide.

In FIG. 4 we show another perspective view of stationary inner housing 9 in order to show locker-ejector pin drive ramp 16 and locker-ejector pin ejector ramp guide 17. Function of these locker-ejector ramps will be further discussed with details of the operation to fix a cartridge into a closeable chamber.

Figure 5:
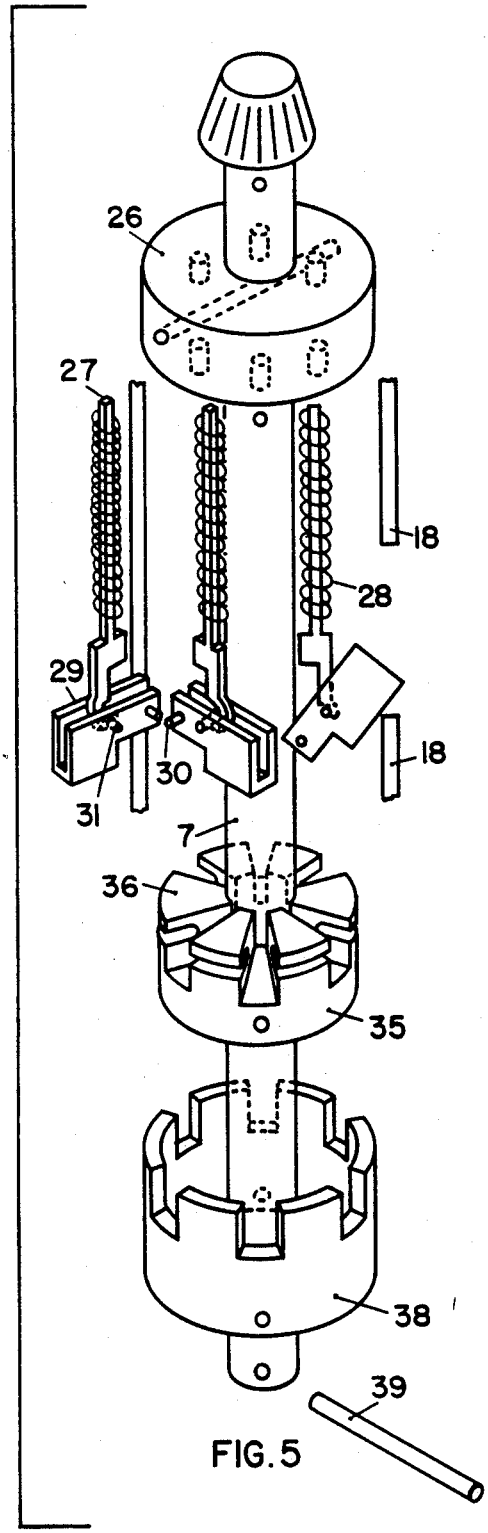
FIG. 5 shows the spring loaded hammer assembly.

In FIG. 5 we show spring loaded hammer assembly fitted on a rearward end of the main drive shaft 7 and inside the stationary inner housing 9. The inner housing 9 is approximately 1½" in diameter and 3" long. A first piece of this spring loaded hammer assembly is a rearward cylindrical spring guide piece 26 which may be about 1¼" in diameter and approximately ½" thick and contains six holes, one for each of six spring loaded hammer drive rods 27 with hammer drive springs 28 and is fastened to the main drive shaft 7. A preferred fastening means is to pin this cylindrical spring guide piece 26 to the main drive shaft 7 but other means such as keying or threading would also be possible. There are six hammer drive rods 27 that move only horizontally, each shaped with a shoulder to compress each hammer drive spring 28 against the bottom of the hole in the rearward cylindrical spring guide piece 26 as a load pin 31 in hammer 29, mounted on hammer pivot pin 30, is moved rearward by a cocking ramp 18 in the stationary inner housing 9 as the main drive shaft 7 is rotated. An inner hammer guide member 35 which may be 1" in diameter may be pinned to the main drive shaft 7. This inner hammer guide member 35 contains six slot forming lobes 36 to form rectangular slots longitudinal to the main drive shaft 7 and rounded grooves at right angles to the main drive shaft 7 with the grooves sized to receive each end of pivot pins 30 that may be ⅛" in diameter and are through a bottom portion of each hammer 29. The hammer load pin 31 may also be approximately ⅛" in diameter and is fastened into the hammer 29 approximately ⅛" above the pivot pin 30; each of six hammers 29 are mounted in the same way and each of the six spring loaded hammer drive rods 27 moveably pushes against each of the hammer load pins 31. An outer hammer guide piece 38 which may be approximately 1¼" in diameter slides over the inner hammer guide member 35 to enclose each of the hammer pivot pins 30 that extend through each of the six hammers 29. Normally the same pin would be used to pin inner hammer guide member 35 and other hammer guide piece 38 to the main drive shaft 7.

Each hammer 29 is ell-shaped and may be approximately ¾" long by ¼" wide and is forced backward by a cocking ramp 18 in the stationary inner housing 9 toward the rearward end of the main drive shaft 7 as the main drive shaft 7 is rotated. When each hammer 29 passes the base of the right triangle shaped opening wherein the hypotenuse forms the cocking ramp 18 pushing the hammer 29 backward, the compressed hammer drive spring 28 snaps the spring loaded hammer drive rod 27 forward to snap the hammer 29 forward against a floating firing pin 41, FIG. 6. As the main drive shaft 7 continues to rotate the hammer 29 is pushed up the ramp to again be in a cocked position as it makes one revolution.

Figure 6:
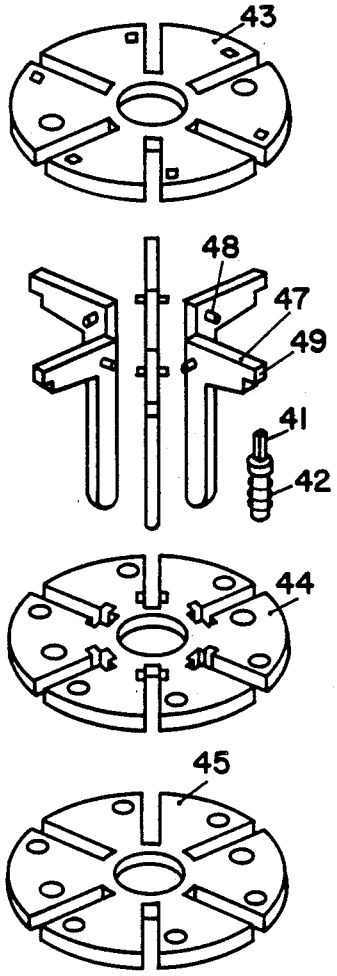
FIG. 6 shows the firing pin and locker ejection assembly.

In FIG. 6 we show a firing pin 41 and locker ejection assembly mounted on the main drive shaft 7 just forward of the outer hammer guides piece 38. This assembly comprises three plates 43, 44 and 45, each of which may be approximately 1⅜" in diameter and ⅛" thick and each of which is rigidly connected to the ⅛" breech plate timing gear 55 by pins 46, FIG. 7, forward of the locker-ejector assembly. The breech plate timing gear 55 is rigidly fastened to the main drive shaft 7 and pins 46, FIG. 6, hold plates 45, 44, and 43 to move with breech plate timing gear 55. The three plates, 43, 44, and 45, could also fastened by welding, threading, or keying. Each of the three plates 43, 44, and 45 have six slots radiating outward from the ell-shaped locker-ejector member 47. The center plate 44 has a smaller slot at right angles to the portion of slot acting as a guide to moveably enclose locker-ejector pivot pin 48 that goes through each locker-ejector member at the base of the ell-shape. Firing pin 41 extends through each of the three plates, 43, 44 and 45, and firing pin spring 42 bottoms against plate 55.

Figure 7:
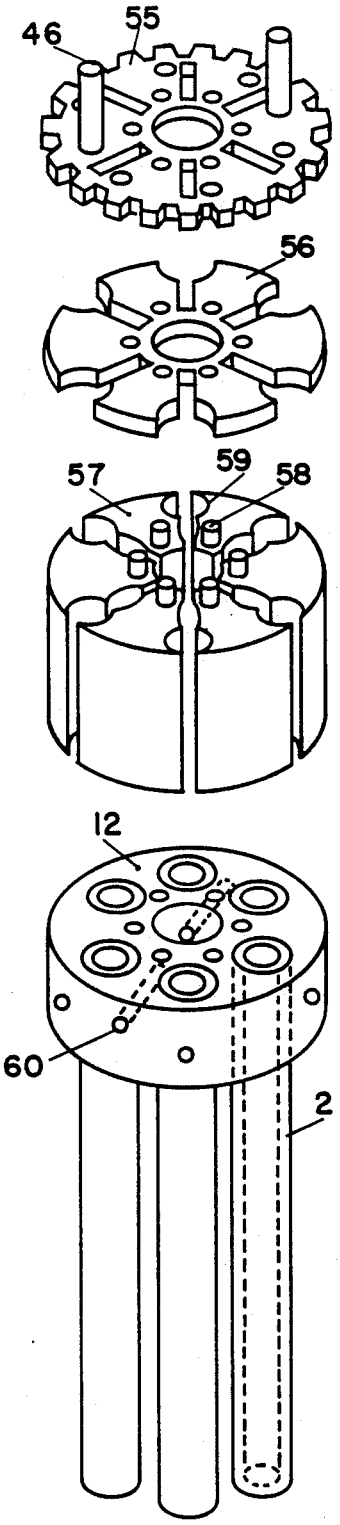
FIG. 7 shows the rotary barrel and cartridge chamber forming assembly.

In FIG. 7 we show the barrel and chamber forming unit comprising:

1. the breech plate timing gear 55 encompassing slots for the six locker-ejector members 47 and six holes to encompass the forward ends of the six firing pins 41 and also six holes to receive the rearward pivot pins 58 of each of the six chamber forming members 57 and with two pins 46 attached that act to pin plates 43, 44, and 45 to the breech plate 55.

2. a cartridge centering plate 56 mounted on the main drive shaft 7 immediately forward from the breech plate timing gear 55; the cartridge centering plate 56 may be approximately 1/16" thick and contains six holes for pivot pins 58 and six slots to act as guides for the locker-ejector members 47, FIG. 6, and a rounded U shape opening to hold the back plate of a cartridge in proper relation to the firing pin 41 and pivotal chamber forming members 57;

3. the six pivotal chamber forming members 57 are formed with a half chamber sized groove 59 on each side of the chamber forming members 57 with each of the six having a pivot pin 58 at each end. These members 57 are pivotally mounted with pins 58 at a rearward end going through holes in the cartridge centering plate 56 and breech plate timing gear 55 and the pins 58 in the forward end going through holes in a barrel mounting base plate 12. The base plate 12 may be more than ½" thick and approximately 1⅝" in diameter. The barrel mounting base plate 12 is fastened rigidly to the main drive shaft 7 by use of a pin 60. Fastening could also be by threading or welding. The barrel mounting base plate 12 has six barrels 2 that may be more than three inches long securely fastened by threading or welding into the base plate 12 with the barrels 2 extending completely through the barrel mounting base plate 12.

Figure 8:
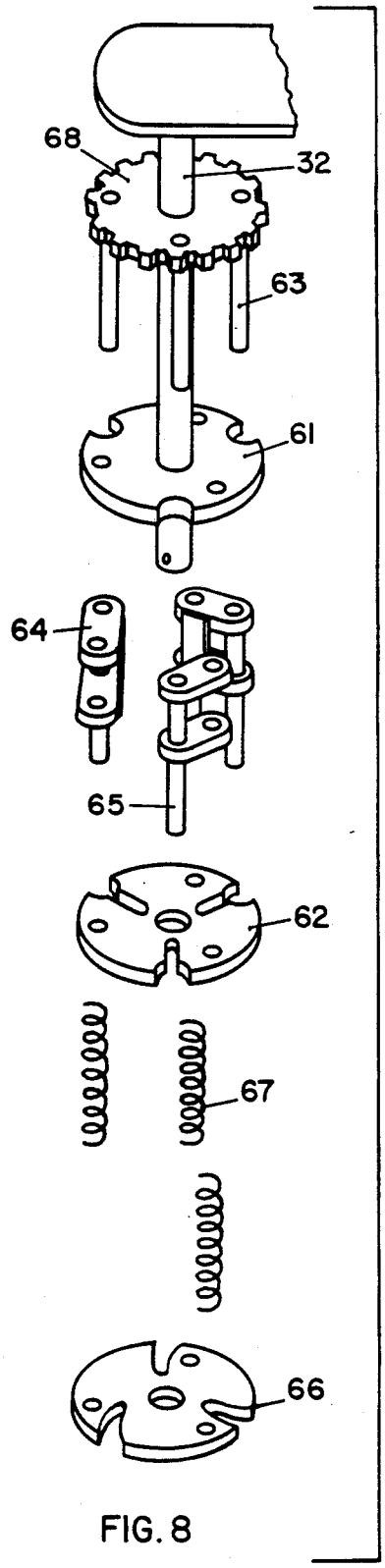
FIG. 8 shows an exploded view of the cartridge feeding assembly.

In FIG. 8 we show the cartridge feeding assembly comprising a cartridge feed drive gear 68, a rearward cartridge holding plate 61, front cartridge holding plate 62 and a drive pin guide plate 66 pivotally mounted on pin 32, FIG. 3, projecting forward from the stationary inner housing 9. The cartridge feed drive gear 68 is exactly one half the diameter of the breech plate timing gear 55 which meshes with cartridge feed drive gear 68. The drive gear 68 has three pins 63 rigidly attached and extending forward through rearward cartridge holding plate 61 that may be about 1/16" thick and have equally spaced semi-circular depressions to fit a 22 caliber shell. Each pin 63 further extends through an inner end of each of three double sided cartridge pushing members 64 and through a front cartridge holding plate 62 and through drive pin guide plate 66. The front cartridge holding plate 62 having three semi-circular cartridge fitting depressions with a smaller depression in the center of each cartridge holding depression to hold cartridge pushing drive pin 65 that extends through each of the double sided cartridge pushing members 64 and into slots in a drive pin guide plate 66. Cartridge pushing springs 67, mounted on each of three pins 63 extending from drive gear 68, act to spring load cartridge pushing drive pins 65 outward while a ramp 10 in the exterior housing 1 guides and releases the cartridge pushing drive pins 65 to push a cartridge contained in a thin flexible belt into chamber forming depressions in the chamber forming members 57, FIG. 7.

Figure 9:
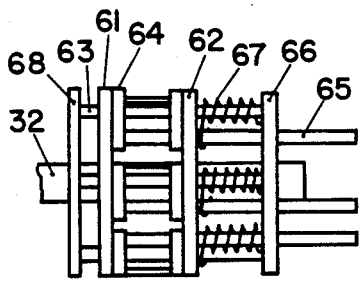

In FIG. 9 we show a side view of the cartridge feeding assembly as discribed under FIG. 8 wherein the assembly is mounted and rotates on pin 32, being driven by cartridge feed drive gear 68; with three double sided cartridge pushing members 64 being rotably mounted on three pins 63 fastened to drive gear 68. The double sided cartridge pushing members 64 are held between a rearward cartridge holding plate 61 and a front cartridge holding plate 62. Cartridge pushing springs 67 act to bias cartridge pushing drive pin 65 upward to push a cartridge into a chamber when pins 65 move to an open part of cartridge pushing drive pin ramp 10.

Figure 10:
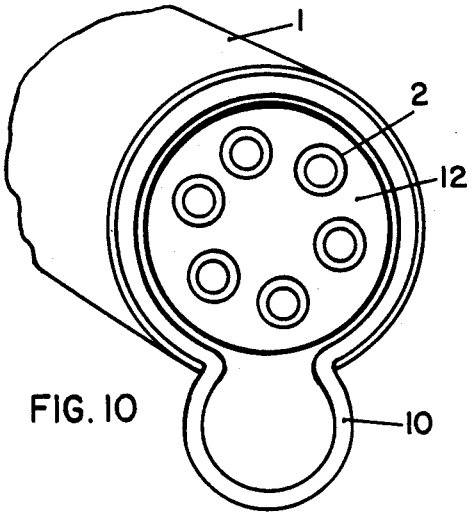
FIG. 10 shows a front view indicating the front bearing support for the rotary barrel assembly and the cartridge pushing drive pin ramp.

In FIG. 10 we show a front view of bearing support and cartridge pushing drive pin ramp 10, which is an integral part of exterior housing 1 and is sized to allow barrel mounting plate 12 to rotate easily. The bearing support portion of 10 preferably has a Teflon insert. The lower open cylindrical portion of ramp 10 acts as a ramp for the cartridge pushing drive pins 65.

Figure 11:
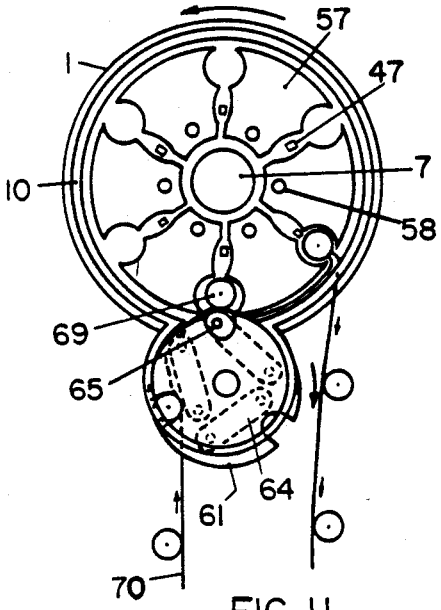
FIG. 11 shows interaction of cartridge feed drive gear and chamber forming members.

In FIG. 11 we show a section A—A of FIG. 1 at the point where locker-ejector member 47 is moved by locker-ejector drive ramp 16 to a position to hold two pivotal chamber forming members 57 in an open position and, at this same point, the open area in bearing support and cartridge pushing drive pin ramp 10 has allowed one of the three cartridge pushing drive pins 65 to push a cartridge 69 between the two pivotal chamber forming members 57.

Figure 12:
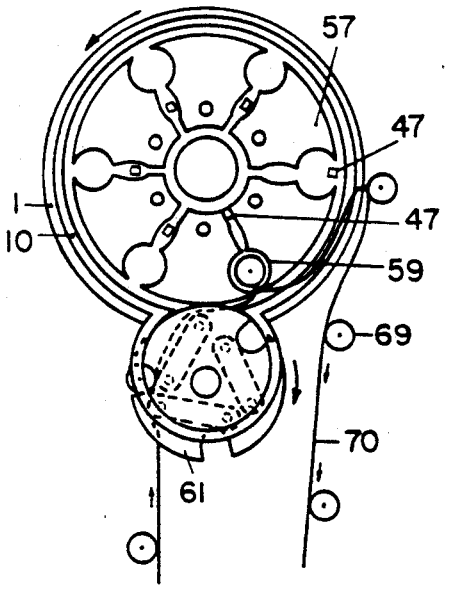
FIG. 12 shows interaction of cartridge feed drive gear indicating action of ejector to expel a spent cartridge.

In FIG. 12, with further movement of the breech plate timing gear 55 that meshes with cartridge feed drive gear 68 one of the six locker-ejector members 47 is pushed downward to a bottom position by locker-ejector pin drive ramp 16 to close the two pivotal chamber forming members 57 tightly around cartridge 69. At this instant movement of the main drive shaft 7 has brought one of the six hammers to the end of hammer cocking ramp 18 and one of the six spring loaded hammer drive rods 27 snaps hammer 29 against one of six firing pins 41 to fire cartridge 69. With further rotation of the main drive shaft 7 the locker-ejector member 47 moves by interaction with ramps as will be shown in FIG. 13 and FIG. 14 to eject spent cartridge 69 while still in belt 70.

With cartridge holding indentations in both the front cartridge holding plate 62 and a rearward cartridge holding plate 61—shown in the FIG. 8—and the cartridge holding plate 62 and 61 being closely adjacent to the pivotal chamber forming members 57, rotation of these members feeds the cartridges 69 in belt 70 into the mechanism.

Figure 13:
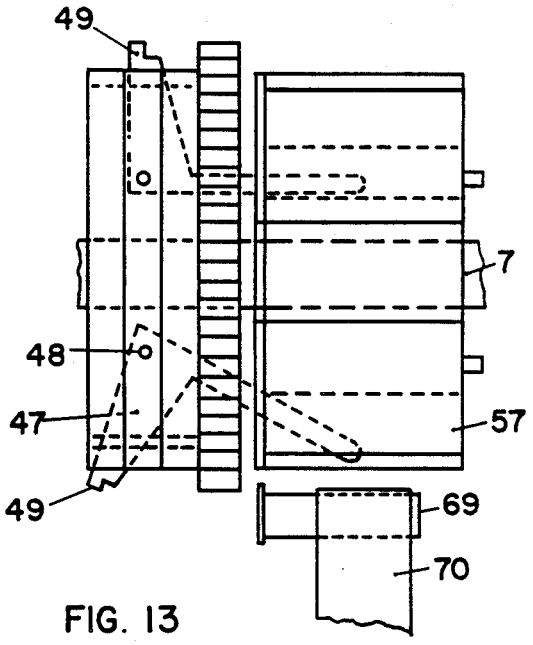
FIG. 13 shows locker-ejector member at the instant a spent cartridge is ejected.
Figure 14:
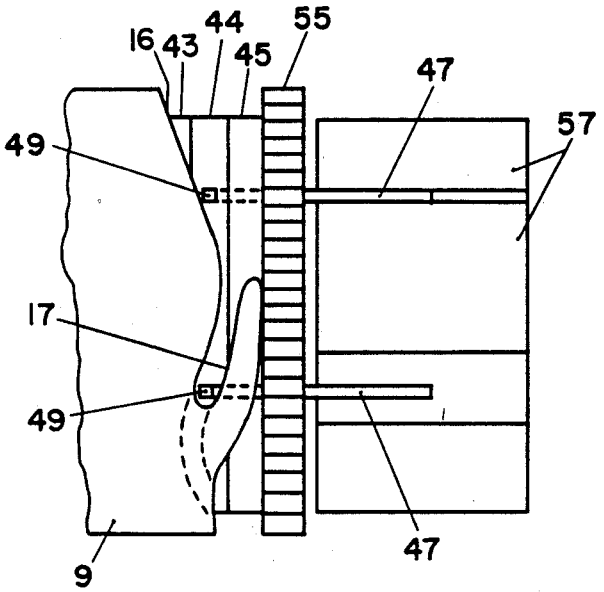
FIG. 14 shows location from a top view as locker-ejector member drive pin moves along locker-ejector pin ramp guide.

FIG. 13 shows one of the six locker-ejector members 47 at the instant the movement past locker-ejector pin ejector ramp guide 17, FIG. 14 pushes locker-ejector member drive pin 49 to cause locker-ejector member 47 to eject spent cartridge 69 in belt 7.

FIG. 14 shows a top view indicating the position of locker-ejector member drive pin 49 in ramp 16 just before further movement to the peak of ramp 16 causes locker-ejector member 47 to lock together pivotal chamber forming members 57. In the lower portion of FIG. 14 we see that movement under and through locker-ejector pin ejector ramp guide 17 kicks locker-ejector member drive pin 49 backwards to cause locker-ejector member 47 to open pivotal chamber forming members 57 and to eject a cartridge.

Figure 15:
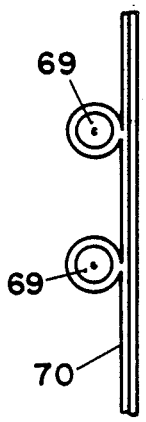
FIG. 15 shows a side view of the special cartridge belt.

FIG. 15 shows a side view of a section of cartridge belt 70 containing two cartridges 69. Several ways, using various types of plastics, for manufacturing a belt containing cartridges may be visualized. A workable prototype has been made by forming a single layer of masking tape around a cartridge; strengthening this by using a short second layer under the cartridge and finally by running a third continuous layer as shown in FIG. 15. Note that this leaves a thin masking tape layer around each cartridge. We would expect several plastics such a Dacron, polyvinylchloride, polypropylene or polythylene could be used to make a thin flexible cartridge holding belt of sufficient strength.

One of normal skill in the art may visualize many minor mechanical changes to the invention as described and we therefore do not wish to be limited to exact details but only as to the general spirit and purpose as outlined in these claims and specifications.

LEGEND—Describing each number on the drawings:

1 external housing
2 barrels
3 trigger switch
4 magazine
5 battery pack holder
6 D.C. motor
7 main drive shaft
8 pinion gear on main drive shaft
9 stationary inner housing
10 bearing support and cartridge pushing drive pin ramp
11 rear bearing for main drive shaft
12 barrel mounting plate
13 pinion gear on D.C. motor
14 threaded bolts fastening together two halves of external housing 1
15 screws connecting external housing 1 to stationary inner housing 9
16 locker-ejector pin drive ramp
17 locker-ejector pin ejector ramp guide
18 hammer cocking ramp
26 cylindrical spring guide piece
27 spring-loaded hammer drive rod
28 hammer drive spring
29 hammer
30 hammer pivot pin
31 hammer load pin
32 cartridge feed unit mounting pin
35 inner hammer guide member
36 slot forming lobes
38 outer hammer guide piece
39 guide pieces fastening pin
41 firing pin
42 firing pin spring
43 rearward plate of locker-ejector assembly
44 center pin holding plate of locker-ejector assembly
45 forward plate to hold pin of locker-ejector assembly in place
46 connecting pins rigidly mounted in breech plate timing gear 55 to connect 43, 44, 45
47 locker-ejector member
48 locker-ejector pivot pin
49 locker-ejector member drive pin
55 breech plate timing gear 56 cartridge centering plate
57 pivotal chamber forming members
58 chamber forming unit pivot pins
59 half-chamber sized groove
60 barrel mounting base plate pin
61 rearward cartridge holding plate
62 a front cartridge holding plate
63 three pins fastened to cartridge feed drive gear 68
64 double sided cartridge pushing members of which there are three
65 cartridge pushing drive pin, of which there are three
66 drive pin guide plate
67 cartridge pushing spring of which there are three
68 cartridge feed drive gear
69 22 cartridge
70 cartridge belt

What is claimed is:

1. A rotary chamber automatic pistol comprising:

1. a main drive shaft;

2. a rotary barrel means connected on a forward end of said main drive shaft:

3. a cylinder forming means pivotably attached between a backplate of said rotary barrel means and a breech plate drive gear timing means rigidly attached to said main drive shaft; said breech plate drive gear timing means co-operating with said cylinder forming means, a cartridge belt feed means, and a first ramp on a stationary inner housing means to align a cartridge with a barrel of said rotary barrel means as said cartridge moves to a position to be tightly held by said cylinder forming means;

4. a locker-ejector means pivotably contained in a center plate of a three plate assembly co-operating with said first ramp on an end of said stationary inner housing means, said breech plate drive gear timing means, and said cylinder forming means to: (a) lock together two pivotal half chamber pieces of said cylinder forming means around said cartridge at the precise time said cartridge is aligned with said barrel; (b) open said two pivotal half chamber pieces; and (c) eject a case of said cartridge after said cartridge is fired;

5. a hammer cocking ramp means in said stationary inner housing means co-operating with a hammer assembly means and said breech plate drive gear timing means to cause a hammer of said hammer assembly means to a strike a floating firing pin means to fire said cartridge at the instant said cartridge is locked in said cylinder forming means and aligned with said barrel;

6. an overall housing containing and attached to said stationary inner housing means and further containing a switch and a battery driven motor drive means in a pistol grip shaped portion of said overall housing means; said motor drive means acting to rotate said main drive shaft thereby firing said rotary barrel pistol when said switch is closed and said cartridge belt feed means, attached to a forward end of said stationary inner housing means co-operates with said breech plate drive gear timing means to feed said cartridges contained in a thin flexible belt means into said cylinder forming means; and 7. a housing comprised of a holder for batteries to drive said battery driven motor drive means and a magazine to store and feed said cartridges contained in said thin flexible belt means to said cartridge feed means is mounted to said stationary inner housing.

* * * * *